US011174080B2

(12) United States Patent
Cępa et al.

(10) Patent No.: US 11,174,080 B2
(45) Date of Patent: Nov. 16, 2021

(54) EASILY OPENABLE PULL-OFF BEVERAGE BOTTLE CLOSURE

(71) Applicant: CAN-PACK METAL CLOSURES SPOLKA Z OGRANICZONA ODPOWIEDZIALNOSCIA, Cracow (PL)

(72) Inventors: Pawel Cępa, Cracow (PL); Aleksander Szymański, Cracow (PL)

(73) Assignee: CAN-PACK METAL CLOSURES SPOLKA Z OGRANICZONA ODPOWIEDZIALNOSCIA, Cracow (PL)

( * ) Notice: Subject to any disclaimer, the term of this patent is extended or adjusted under 35 U.S.C. 154(b) by 0 days.

(21) Appl. No.: 17/042,793

(22) PCT Filed: Mar. 25, 2019

(86) PCT No.: PCT/IB2019/052397
§ 371 (c)(1),
(2) Date: Sep. 28, 2020

(87) PCT Pub. No.: WO2019/186363
PCT Pub. Date: Oct. 3, 2019

(65) Prior Publication Data

US 2021/0016933 A1 Jan. 21, 2021

(30) Foreign Application Priority Data

Mar. 28, 2018 (PL) ..... 425070

(51) Int. Cl.
*B65D 41/42* (2006.01)
*B65D 53/04* (2006.01)

(52) U.S. Cl.
CPC ..... *B65D 41/425* (2013.01); *B65D 53/04* (2013.01)

(58) Field of Classification Search
CPC ..... B65D 41/425; B65D 53/04
(Continued)

(56) References Cited

U.S. PATENT DOCUMENTS 2,068,444 A * 1/1937 Breckenridge ..... B65D 51/243 215/254
3,380,609 A * 4/1968 Potts ..... B65D 41/42 215/254
(Continued)

FOREIGN PATENT DOCUMENTS

GB 1277396 6/1972
JP 2008174266 A 7/2008
(Continued)

OTHER PUBLICATIONS

Polish Search Report for P425070—dated Apr. 27, 2018.
International Search Report for PCT/IB2019/052397—dated Jul. 15, 2019.

*Primary Examiner* — J. Gregory Pickett
*Assistant Examiner* — Niki M Eloshway
(74) *Attorney, Agent, or Firm* — The Maxham Firm; Lawrence A. Maxham

(57) ABSTRACT

An easily operable pull-off beverage bottle closure. The closure has a shell, a pull tab, and a liner covering the inner section of the shell providing circumferential sealing. The shell has score lines running on both sides of the pull tab enabling to tear off the closure. The liner is affixed to the inner upper section of the closing plane and covers the surface bigger than the surface limited by the score lines running through the upper plane of the shell.

4 Claims, 3 Drawing Sheets

(58) Field of Classification Search
USPC ..... 220/270, 276; 215/253, 256
See application file for complete search history.

(56) References Cited

U.S. PATENT DOCUMENTS

| | | | | |
|---|---|---|---|---|
| 3,963,140 | A | 6/1976 | Harding | |
| 3,974,931 | A * | 8/1976 | Moller | B65D 41/42 215/254 |
| 4,003,488 | A * | 1/1977 | Moller | B65D 41/42 215/254 |
| 4,340,149 | A * | 7/1982 | Mori | B29C 70/80 215/343 |
| 4,379,512 | A * | 4/1983 | Ohmi | B65D 53/04 215/327 |
| 4,415,096 | A * | 11/1983 | Ohmi | B65D 53/04 215/343 |
| 4,605,137 | A | 8/1986 | Taragna et al. | |
| 4,887,732 | A | 12/1989 | Matsubayashi et al. | |
| 9,969,539 | B2 * | 5/2018 | Genaw, Jr. | B65D 47/126 |
| 10,954,040 | B2 * | 3/2021 | Lo Piccolo | B65D 53/04 |
| 2006/0043053 | A1 * | 3/2006 | Herald | B65D 41/485 215/253 |
| 2008/0283486 | A1 | 11/2008 | Magnusson | |
| 2016/0207671 | A1 | 7/2016 | Okubo et al. | |

FOREIGN PATENT DOCUMENTS

| | | | |
|---|---|---|---|
| JP | 2011173594 | A | 9/2011 |
| JP | 2017154809 | A | 9/2017 |

* cited by examiner

EASILY OPENABLE PULL-OFF BEVERAGE BOTTLE CLOSURE

FIELD OF THE INVENTION

The present invention concerns an easily openable pull-off beverage bottle closure.

BACKGROUND OF THE INVENTION

Currently the easily openable closures (most often the crown caps pull-off type) available on the market include a pull tab (a pull-ring) connected with the closure shell. The closure shell is made of metal alloys, most often of aluminum alloys or steel alloys. The pull-ring may be made of metal or plastic. On the closure shell there are typically two non-visible score lines.

To open the bottle the pull tab is pulled upwardly, in order to tear the part between two invisible score lines on the shell from the remaining part of the closure, and then to fully open the bottle. The inner part of the closure shell is covered with a liner made of plastic, which fills the space between the bottle and the upper part of the shell. Such solution is, for instance, known from patent specification EP1621475B1.

Patent specification WO 2015/025737 discloses a solution referring to an easily openable container closure, where the closure includes a shell and a liner (a seal) mourned to the inner surface of the upper part of the shell, and the shell has a pair of score lines. The liner is thinner in the central section, and thicker in the peripheral edge section. The liner is placed between the score lines in such a way that its peripheral edge extends along the score lines.

So far, the prior efforts have focused on facilitation of opening of the closures, or improvement of their integrity. There has not generally been a focus on improvement of safety of those types of closures. However, after opening of the bottle and separation of the part of the shell between the score lines from its body, the torn part of the shell typically has sharp edges that can hurt the person opening the bottle. Unexpectedly, the inventors of the embodiment described herein have found that it is possible to secure the sharp edges of the shell with the use of relatively simple means.

BRIEF DESCRIPTION OF THE DRAWING

The objects, advantages and features of the invention embodiments disclosed herein will be more easily understood from the following detailed description, when read in conjunction with the accompanying drawing, in which.

DETAILED DESCRIPTION OF EMBODIMENTS OF THE INVENTION

Figure 1:
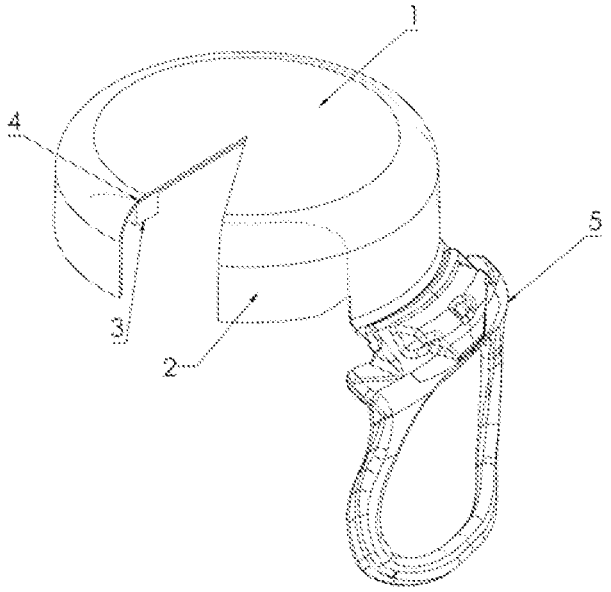
FIG. 1 is a top perspective view of a preferred embodiment of the present invention, where part of the closing plane and the skirt wall are removed to show the liner.
Figure 2:
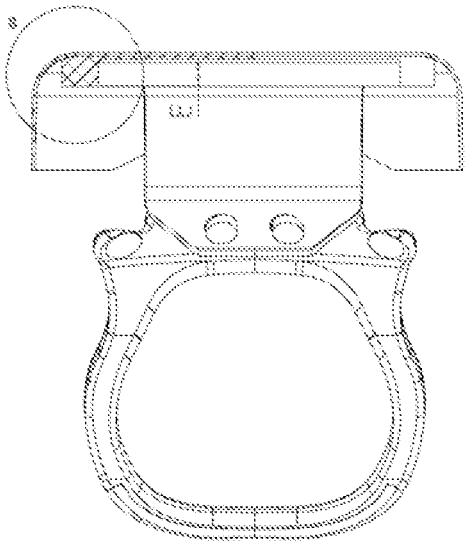
FIG. 2 is a front view of the embodiment of FIG. 1, where the cross-section of the shell is visible to show the liner.

The embodiment shown in the drawing has an easily openable pull-off beverage bottle closure consisting of a shell, a pull tab, and a liner covering the inner section of the shell providing circumferential sealing. The shell has an upper closing plane and a skirt wall shaped from the outer part of the upper part of the closing plane, and the pull tab is connected with the skirt wall. The shell has score lines running on both sides of the pull tab from the skirt wall through the upper plane enabling the closure to be torn off in accordance with the described embodiment.

The liner is affixed to the inner upper section of the closing plane and covers the surface bigger than the surface limited by the score lines running through the upper plane of alae shell. The liner is affixed with the use of a coating increasing the adhesion. The term "the coating increasing the adhesion" shall be understood as a coating applied to the inner surface of the shell upper panel (plane) in order to enable connection of the metal sheet, of which the shell is made, with the plastic, of which the liner is made. In particular, a coating, is obtained by application of lacquer or glue or another known substance, or by increasing the adhesion of the metal sheet in another known way, such as, for example, by treatment with gas plasma.

The distance from the score line to the outer edge of the liner is from 0.05 to 1.2 mm. As a result the diameter of the liner is bigger than the maximal diameter of the torn part of the shell limited by the score lines. Sharp edges of the shell formed after pulling the pull tab upwardly and tearing, the score lines on the shell are secured by the liner. The liner is affixed to the inner surface of the shell strongly enough that, after the pull tab is pulled upwardly, the whole liner together with the torn part of the shell goes upward and does not stay on the bottle.

The coating increasing the adhesion, which affixes the liner to the inner surface of the closing plane, is situated in the distance of at least 0.1 mm from the score line measured on the inner surface of the shell in the radial direction to the skirt wall and in the distance of at least 1.5 mm measured on the inner surface of the shell in the radial direction to the upper closing plane.

The ratio of the distance from the score line to the outer edge of the liner to the height of the liner is from about 0.02 to 1. It ensures that the opening is easy, on condition that after the pull tab is pulled upward the liner, together with the torn part of the shell, goes upward, not staying on the bottle.

With reference specifically to the drawing, the pull-off beverage bottle closure, where the shell is made of metal alloy, consists of upper closing plane 1 and skirt wall 2. Liner 3 is affixed to the inner surface of closing plane 1 of a coating increasing the adhesion and provides circumferential sealing. Score lines 4 on closing plane 1 and skirt wall 2 enable tearing of the closure by means of pull tab 5.

Figure 3:
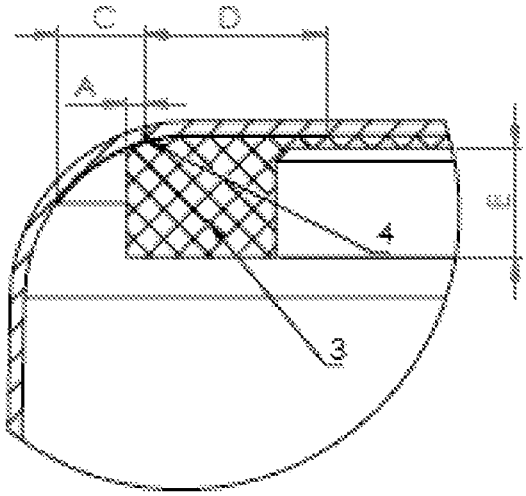
FIG. 3 is a partial cross-section view of the top left part of the shell of the FIG. 1 embodiment.
Figure 4:
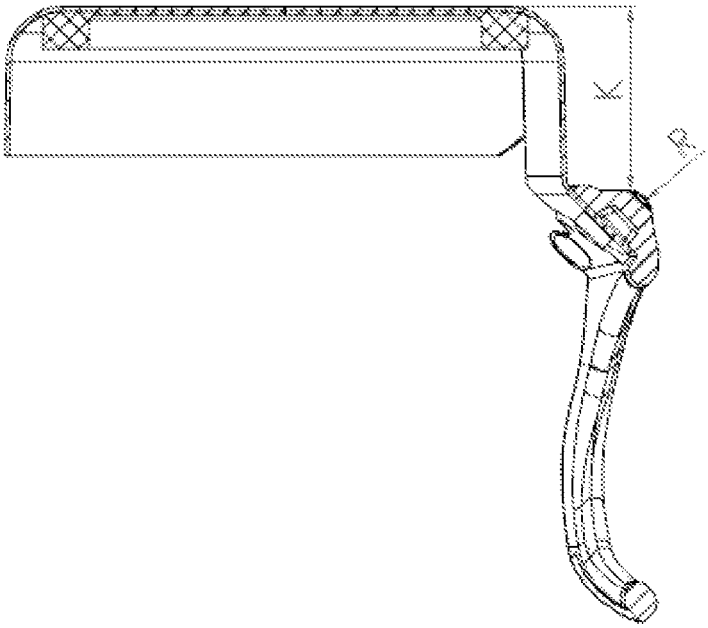
FIG. 4 a side view of the embodiment of FIG. 1, where the cross-section of the shell is visible to show the liner.
Figure 5:
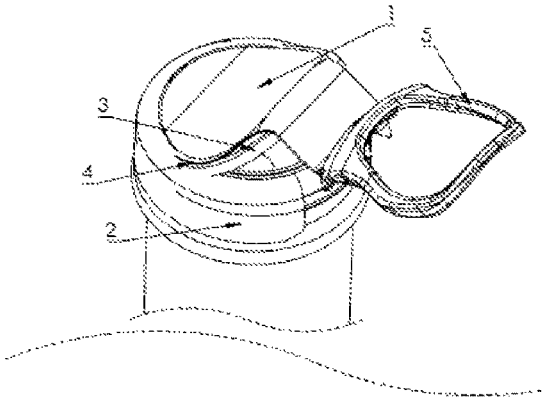
FIG. 5 is a top perspective view of the bottle closure placed on the top of the bottle neck of the FIG. 1 embodiment, where the pull tab is torn off to reveal the liner.
Figure 6:
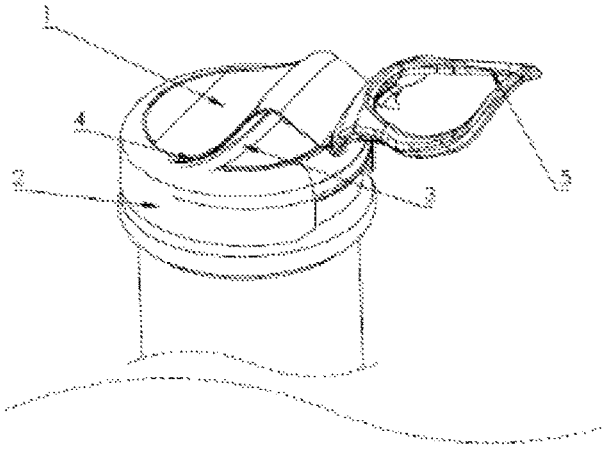
FIG. 6 is a side perspective view of the embodiment shown in FIG. 5.
Figure 7:
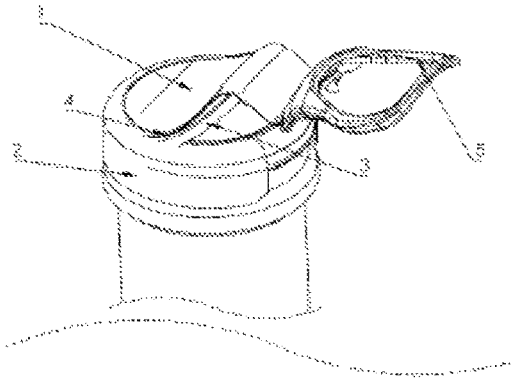
FIG. 7 is a side perspective view of the embodiment of FIG. 5.

The distance A (FIG. 3) from score line 4 to the outer edge of liner 3 is from about 0.05 to about 1.2 mm. The coating increasing the adhesion, which affixes liner 3 to the inner surface of upper closing plane 1, is in the distance C of at least 0.1 mm from score line 4, measured on the inner surface of the shell in the radial direction to skirt wall 2, and in the distance D of at least 1.5 mm, measured on the inner surface of the shell in the radial direction to upper closing plane 1.

The ratio of the distance A from score line 4 to the outer edge of liner 3 to the height E of liner 3 is from about 0.02 to 1.

After pulling pull tab 5 the score lines 4 are torn and the part of closing plane 1 and the part of skirt wall 2 are pulled upward. The liner 3 going upward covers the sharp edges formed after tearing score lines 4.

The invention claimed is:

1. An easily openable pull-off beverage bottle closure comprising:

a shell, a pull tab, and a liner covering the inner section of the shell providing circumferential sealing;

the shell has an upper closing plane and a skirt wall shaped from the outer part of the upper part of the closing plane;

the pull tab is connected with the skirt wall;

the shell is formed with score lines running on the both sides of the pull tab from the skirt wall through the upper closing plane enabling to tear off the bottle closure;

the liner is affixed to an inner upper section of the upper closing plane and covers a surface bigger than the surface defined by the score lines running through the upper closing plane of the shell, the liner remaining secured to the inner upper section of the upper closing plane when the upper closing plane defined by the score lines is torn off; and a distance (A) from the score line to the outer edge of the liner is from about 0.05 to about 1.2 mm, enabling exposed edges of the torn off upper closing plane to be covered by the liner upon removal.

2. The bottle closure according to claim 1, and further comprising a coating which increases the adhesion which affixes the liner to the inner surface of the upper closing plane, is in the distance (C) of at least 0.1 mm from the score line measured on the inner surface of the shell in the radial direction to the skirt wall and in the distance (D) of at least 1.5 mm measured on the inner surface of the shell in the radial direction to the upper closing plane.

3. The bottle closure according to claim 2, wherein the ratio of the distance (A) from the score line to the outer edge of the liner to the height of the liner (E) is from about 0.02 to 1.

4. The bottle closure according to claim 1, wherein the ratio of the distance (A) from the score line to the outer edge of the liner to the height of the liner (E) is from about 0.02 to 1.

* * * * *